US009520114B2

(12) United States Patent
Omoumi

(10) Patent No.: US 9,520,114 B2
(45) Date of Patent: Dec. 13, 2016

(54) PERCUSSION TUNING METHOD, SYSTEM, AND APPARATUS

(71) Applicant: Hossein Omoumi, Irvine, CA (US)

(72) Inventor: Hossein Omoumi, Irvine, CA (US)

( * ) Notice: Subject to any disclaimer, the term of this patent is extended or adjusted under 35 U.S.C. 154(b) by 0 days.

(21) Appl. No.: 14/283,157

(22) Filed: May 20, 2014

(65) Prior Publication Data

US 2015/0340019 A1 Nov. 26, 2015

(51) Int. Cl.
*G10D 13/02* (2006.01)

(52) U.S. Cl.
CPC ..... *G10D 13/023* (2013.01)

(58) Field of Classification Search
CPC ..... G10D 13/023
USPC ..... 84/413
See application file for complete search history.

(56) References Cited

U.S. PATENT DOCUMENTS 3,163,075 A * 12/1964 Toperzer, Jr. ..... G10D 13/04 84/419
4,635,524 A * 1/1987 Allen ..... G10D 13/04 84/411 A
6,043,421 A * 3/2000 Adams ..... G10D 13/04 84/419
6,667,432 B2 * 12/2003 Brando ..... G10D 13/023 84/411 R
2014/0060286 A1 * 3/2014 Yovino ..... G10D 13/023 84/413

* cited by examiner

*Primary Examiner* — Jianchun Qin
(74) *Attorney, Agent, or Firm* — Arjomand Law Group, PLLC

(57) ABSTRACT

An acoustic-drum tuning method, apparatus, and a system are disclosed which are configured to tune different regions of the drumhead membrane separately or the drumhead membrane in its entirety. Various embodiments of the acoustic-drum tuning assembly include a single adjustment feature to vary the drumhead tension uniformly around the drumhead's periphery and include multiple other adjustment features to vary the drumhead tension non-uniformly around the drumhead's periphery In some embodiments the tuning mechanism includes a semi flexible hoop or rim, for example a semi-rigid metal hoop, that restraints the drumhead membrane with respect to the drum. The restraining hoop may be pulled uniformly away from the drumhead to uniformly increase the tension in the drumhead membrane and/or may be pulled non-uniformly away from the drumhead to increase the tension in the drumhead membrane non-uniformly.

20 Claims, 4 Drawing Sheets

PERCUSSION TUNING METHOD, SYSTEM, AND APPARATUS

TECHNICAL FIELD

This application relates generally to acoustic musical instruments, and more particularly, to a drumhead membrane tuning apparatus and method for percussion instruments.

BRIEF DESCRIPTION OF THE DRAWINGS

The drawings, when considered in connection with the following description, are presented for the purpose of facilitating an understanding of the subject matter sought to be protected.

DETAILED DESCRIPTION

Figure 1:
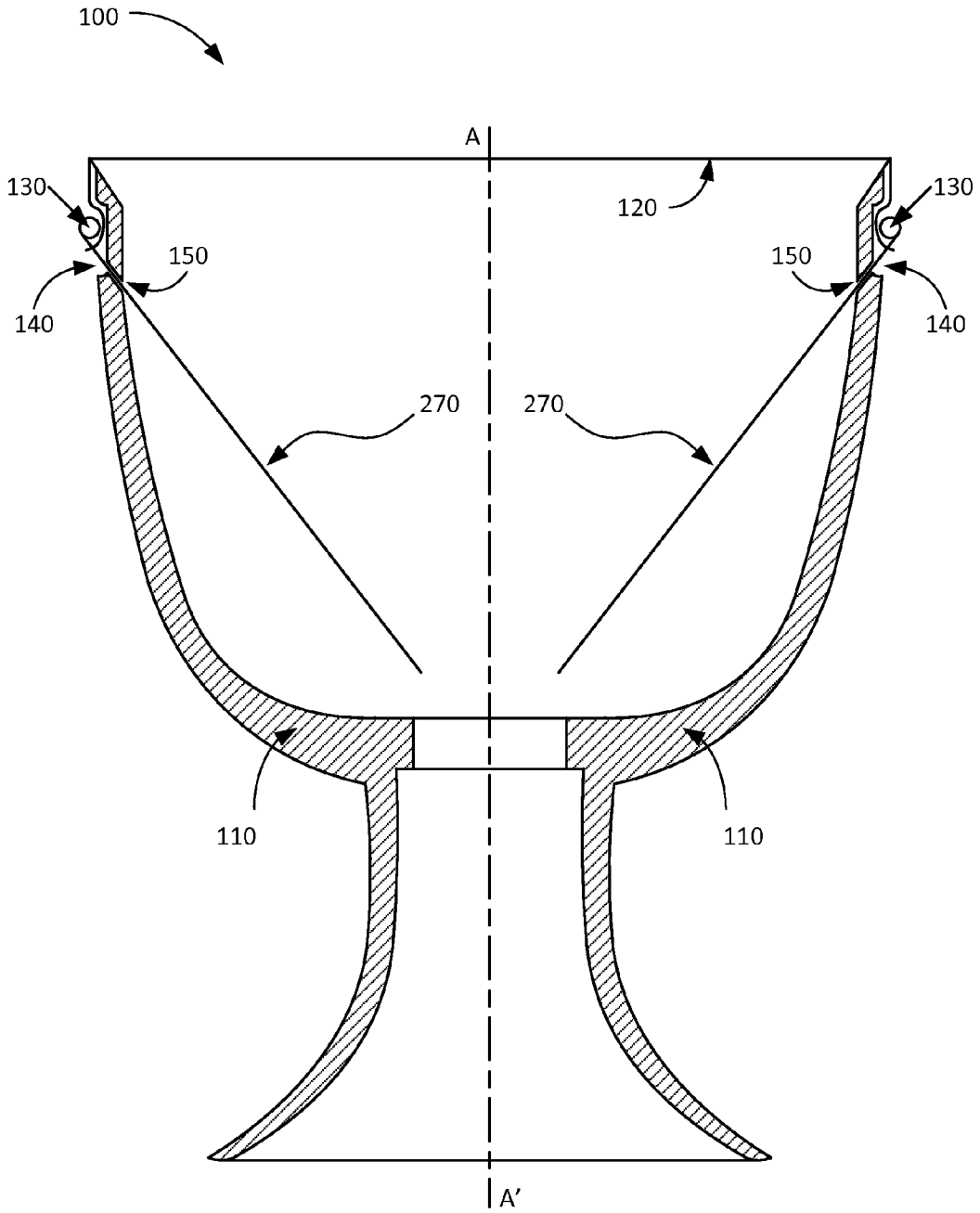
FIG. 1 shows a cross-sectional view of an example percussion instrument.

While the present disclosure is described with reference to several illustrative embodiments described herein, it should be clear that the present disclosure should not be limited to such embodiments. Therefore, the description of the embodiments provided herein is illustrative of the present disclosure and should not limit the scope of the disclosure as claimed. In addition, while the following description references a traditional Persian drum called "Tombak" it will be appreciated that the disclosure may include other national and international percussion instruments.

Natural or synthetics skin percussion instruments, which use animal skin or synthetics materials as their drumhead membrane, comprise a resonance box with a skin stretched across either or both ends of the resonance box. Tuning of these instruments is accomplished by changing the tension of the drumhead membrane. Traditionally, changing the skin tension is achieved by adjusting many ropes, several leather straps, or multiple nuts and bolts, all of which are traditionally mounted on the outside or the external surface of the resonance box. However, in the case of percussion instruments that are in direct contact with the musician's body, such as the Iranian Tombak, any external fittings or attachments would prevent the free movement of the player's hands or the free movement of the instrument in player's hands, making it difficult to play. Additionally, it is desired to change the skin tension of the drumhead by a single adjustment.

Because the tension in the drumhead membrane and its sound changes as temperature and/or humidity vary, the disclosed apparatus and method allows quick and easy re-tuning of the instrument during a live performance or recording. One of the advantages of the disclosed tuning apparatus is that the tuning apparatus is housed inside the percussion instrument and neither alters the appearance of the instrument nor interferes with the player's movements. Another advantage of the disclosed tuning apparatus is the possibility of changing the skin tension of the drumhead by a single adjustment. A third advantage of the disclosed tuning apparatus is the ability to easily tune either the separate regions of the drumhead membrane or the entirety of the drumhead membrane.

Briefly described, a method and an article of manufacture are disclosed for changing the tension of the drumhead membrane locally or globally over the entire surface of the membrane. The disclosed article of manufacture includes multiple cables, each of which is attached to a different location at the periphery of the drumhead membrane. Pulling each cable will pull the membrane from a different side, which creates tension in a corresponding part of the membrane. Pulling all cables at once will pull the membrane from all sides, depending on the cable arrangement with respect to membrane boundary, and creates tension in the entire membrane. One wheel or screw in the disclosed tuning apparatus is configured to pull or loosen all the cables at the same time while other wheels or screws are configured to tighten or relax only one or a selected few of the cables. It is important to note that the friction between the drumhead membrane and the drumhead ridge, over which the membrane lies, helps the local tuning of the membrane and prevents the local tension created by a single cable to be spread throughout the membrane.

FIG. 1 shows a cross-sectional view of an example percussion instrument. The example instrument shown in FIG. 1 is a wooden Persian percussion instrument with the traditional resonance box 110 and traditional skin membrane 120. The geometric shape of the resonance box 110 can be imagined to be the result of rotating cross-section 110 around A-A' axis. Customarily, the skin membrane 120 is glued to the edge of resonance box 110. In this disclosure, to be tunable, the membrane 120 is attached to a curved bracket or hoop 130 which may be one piece or several pieces and/or may be rigid, semi-rigid, or flexible. FIG. 1 shows bracket 130 to be in a groove 140 which makes the look of the instrument more traditional; however, bracket 130 does not need to be in any groove. At desired points along the length of bracket 130, cables 270 are attached to the bracket 130 and are directed toward inside of the resonance box 110 through holes 150 that are drilled into the walls of the resonance box 110. As will be described in detail, pulling cables 270 from inside the resonance box 110 creates tension within the membrane 120. Pulling all cables 270 together at the same time results in creation of a uniform tension throughout membrane 120; however, puling each cable 270 separately with different forces creates different localized tensions in the membrane 120. Those skilled in the art will recognize that cables 270 may be attached to the membrane 120 without the hoop or bracket 130.

Figure 2A:
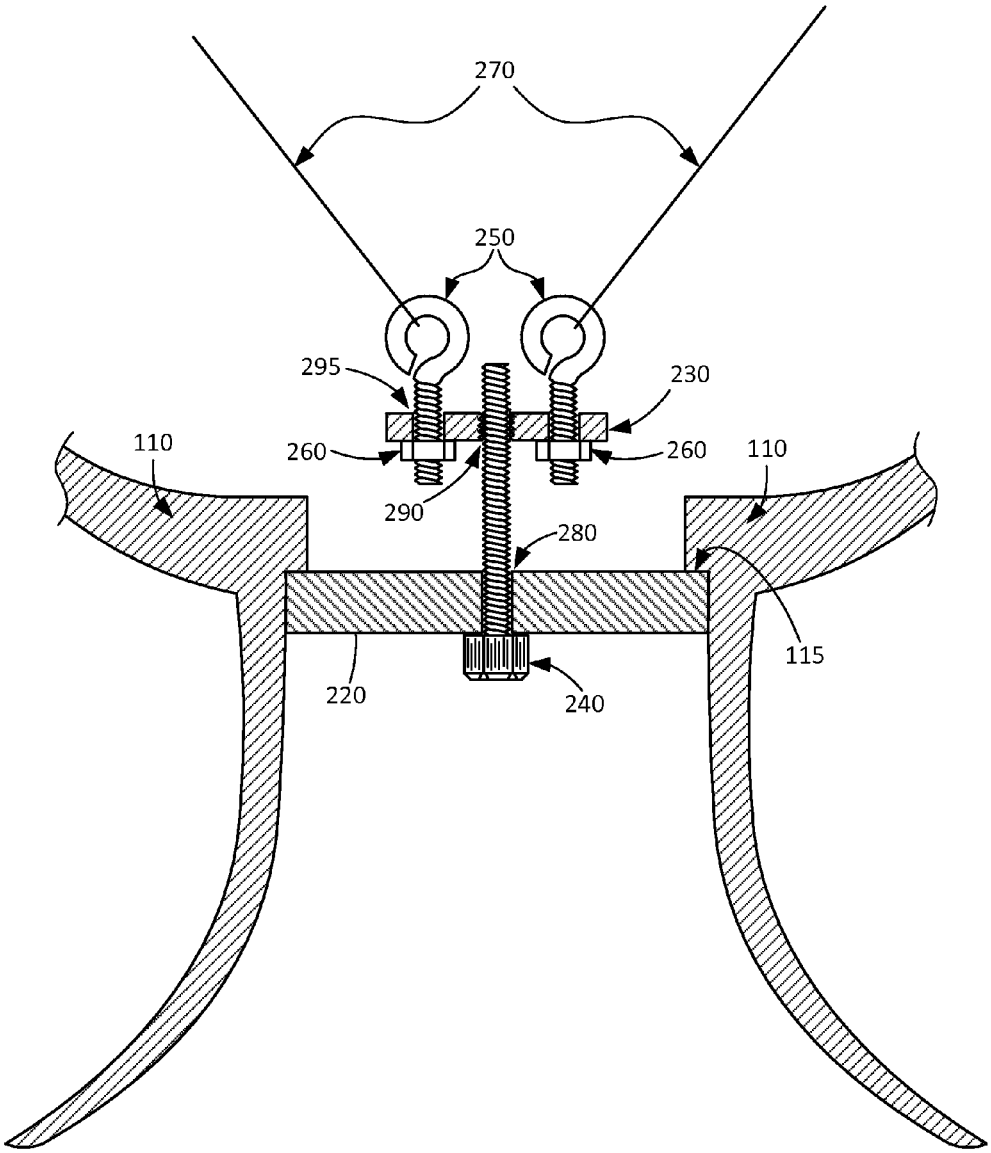
FIGS. 2A and 2B show cross-sectional views of example tuning apparatus installed within the percussion instrument of FIG. 1.

FIG. 2A shows a cross-sectional view of an example tuning apparatus installed within the percussion instrument of FIG. 1. In this embodiment the tuning apparatus is configured to pull or loosen cables 270 either individually or jointly. While pulling cables 270, the movement of the stationary base structure 220 of the tuning apparatus is restricted by ridge 115 of resonance box 110. Those skilled in the art will recognize that the position of the base structure 220 with respect to the resonance box 110 can be fixed in many other ways that do not require having a ridge. The moveable structure/plate 230 may be pulled toward stationary base structure 220 by screw 240 which passes freely through the hole 280 of the stationary base structure 220 but engages the threads of the threaded hole 290 of the moveable plate 230. One or more of cables 270 may be connected to each of the example eye-bolts 250, each of which pass through a hole 295 of the moveable plate 230 and is retained by a nut 260. Tightening screw 240 pulls the moveable plate 230 towards stationary base structure 220 and away from the membrane 120, causing all cables 270 to be pulled collectively. On the other hand, tightening each nut 260 will pull only those cables 270 that are connected to the corresponding eye-bolt 250.

Figure 2B:
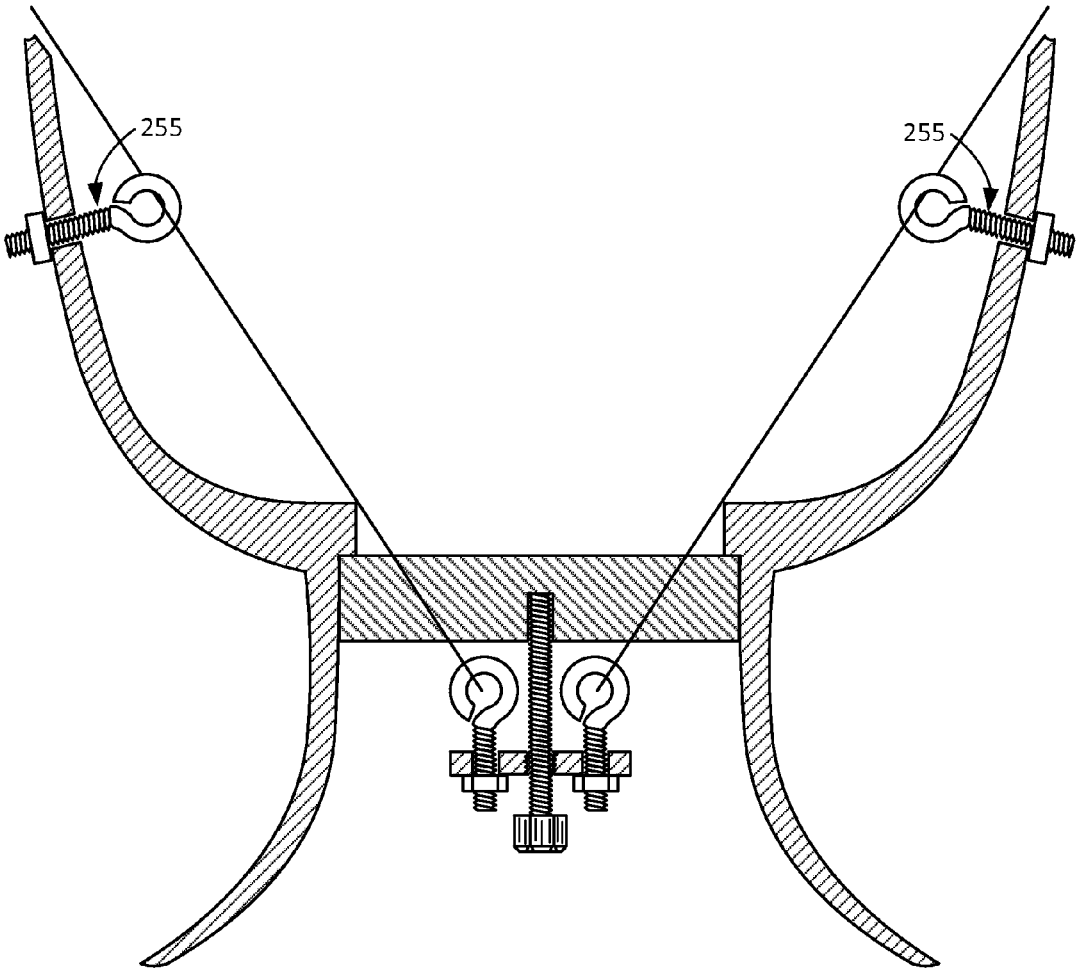

In the embodiment of FIG. 2A, the moveable structure/plate 230 is located between the base structure 220 and the membrane of the percussion instrument. In other embodiments, as shown in FIG. 2B, the moveable structure/plate 230 may be located on the opposite side of the base structure 220 such that the base structure 220 is situated between the moveable structure/plate 230 and the membrane of the percussion instrument. In such embodiments as shown in FIG. 2B, increasing the distance between the moveable structure/plate 230 and the base structure 220 will increase the tension in cables 270 and in the membrane; however, in the embodiment of FIG. 2A decreasing the distance between the moveable structure/plate 230 and the base structure 220 increases the tension in cables 270 and in the membrane.

In various embodiments the cables 270 may be also pulled by other means than by eye-bolts 250. For example the cables 270 may be pulled towards the walls of the resonance box 110 by additional cables or bolts 255, shown in FIG. 2B, that pass through holes drilled in the walls of the resonance box 110 for this purpose. In such embodiments the tension in individual cables 270 may be adjusted from the sides of the instrument.

Figure 3:
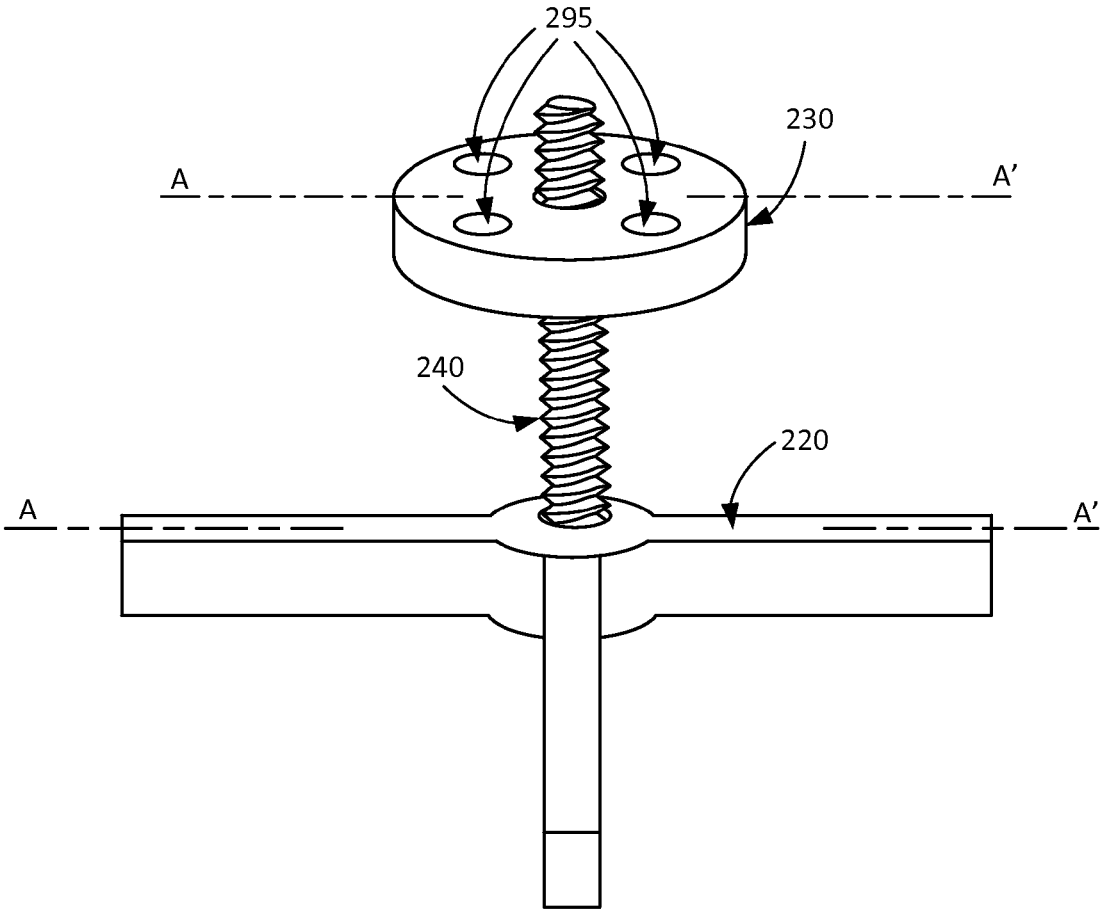
FIG. 3 shows an isometric view of the example tuning apparatus shown in FIG. 2A.

FIG. 3 shows an isometric view of the example tuning apparatus shown in FIG. 2A. In this embodiment the example stationary base structure 220 has four arms to engage ridge 115. Moveable plate 230 in this embodiment is in the form of a round disk with four holes 295 to accommodate four eye-bolts 250. The space between the stationary base arms provides ample space for reaching and adjusting nuts 260. The example stationary base structure 220 can itself be a round disk with some holes for reaching nuts 260.

Changes can be made to the claimed invention in light of the above Detailed Description. While the above description details certain embodiments of the invention and describes the best mode contemplated, no matter how detailed the above appears in text, the claimed invention can be practiced in many ways. Details of the system may vary considerably in its implementation details, while still being encompassed by the claimed invention disclosed herein.

Particular terminology used when describing certain features or aspects of the invention should not be taken to imply that the terminology is being redefined herein to be restricted to any specific characteristics, features, or aspects of the invention with which that terminology is associated. In general, the terms used in the following claims should not be construed to limit the claimed invention to the specific embodiments disclosed in the specification, unless the above Detailed Description section explicitly defines such terms. Accordingly, the actual scope of the claimed invention encompasses not only the disclosed embodiments, but also all equivalent ways of practicing or implementing the claimed invention.

The above specification, examples, and data provide a complete description of the manufacture and use of the composition of the invention. Since many embodiments of the invention can be made without departing from the spirit and scope of the invention, the invention resides in the claims hereinafter appended. It is further understood that this disclosure is not limited to the disclosed embodiments, but is intended to cover various arrangements included within the spirit and scope of the broadest interpretation so as to encompass all such modifications and equivalent arrangements.

It will be understood by those within the art that, in general, terms used herein, and especially in the appended claims (e.g., bodies of the appended claims) are generally intended as "open" terms (e.g., the term "including" should be interpreted as "including but not limited to," the term "having" should be interpreted as "having at least," the term "includes" should be interpreted as "includes but is not limited to," etc.). It will be further understood by those within the art that if a specific number of an introduced claim recitation is intended, such an intent will be explicitly recited in the claim, and in the absence of such recitation no such intent is present. For example, as an aid to understanding, the following appended claims may contain usage of the introductory phrases "at least one" and "one or more" to introduce claim recitations. However, the use of such phrases should not be construed to imply that the introduction of a claim recitation by the indefinite articles "a" or "an" limits any particular claim containing such introduced claim recitation to inventions containing only one such recitation, even when the same claim includes the introductory phrases "one or more" or "at least one" and indefinite articles such as "a" or "an" (e.g., "a" and/or "an" should typically be interpreted to mean "at least one" or "one or more"); the same holds true for the use of definite articles used to introduce claim recitations. In addition, even if a specific number of an introduced claim recitation is explicitly recited, those skilled in the art will recognize that such recitation should typically be interpreted to mean at least the recited number (e.g., the bare recitation of "two recitations," without other modifiers, typically means at least two recitations, or two or more recitations). Furthermore, in those instances where a convention analogous to "at least one of A, B, and C, etc." is used, in general such a construction is intended in the sense one having skill in the art would understand the convention (e.g., "a system having at least one of A, B, and C" would include but not be limited to systems that have A alone, B alone, C alone, A and B together, A and C together, B and C together, and/or A, B, and C together, etc.). It will be further understood by those within the art that virtually any disjunctive word and/or phrase presenting two or more alternative terms, whether in the description, claims, or drawings, should be understood to contemplate the possibilities of including one of the terms, either of the terms, or both terms. For example, the phrase "A or B" will be understood to include the possibilities of "A" or "B" or "A and B."

While the present disclosure has been described in connection with what is considered the most practical and preferred embodiment, it is understood that this disclosure is not limited to the disclosed embodiments, but is intended to cover various arrangements included within the spirit and scope of the broadest interpretation so as to encompass all such modifications and equivalent arrangements.

What is claimed is:

1. A tuning apparatus for tuning a percussion instrument that has a resonance box and a drumhead membrane which covers at least one side of the resonance box, the tuning apparatus comprising:

a base-structure situated inside the resonance box, in contact with or attached to inside of the resonance box, such that the base-structure does not move with respect to the resonance box during tuning;

an adjustment-plate moveably attached to the base-structure, wherein a distance between the base-structure and the adjustment-plate is adjustable by a plate-adjusting-component;

multiple cable-adjusting-components moveably mounted on the adjustment-plate;

multiple cables that connect the cable-adjusting-components to the membrane's circumference, wherein one side of each cable is attached to the membrane's circumference and another side of each cable is directly connected to one of the cable-adjusting-components and wherein each of the cable-adjusting-components is only connected to a subset of the multiple cables; and wherein moving at least one cable-adjusting-component relative to the adjustment-plate changes the tension in the cable(s) connected to the cable-adjusting-component and tunes the membrane regionally and moving the adjustment-plate relative to the base-structure changes the tension in all cables and tunes the membrane globally.

2. The tuning apparatus of claim 1, wherein the membrane is animal skin or synthetics.

3. The tuning apparatus of claim 1, wherein the resonance box is wooden, metal, fiberglass, or any synthetic material.

4. The tuning apparatus of claim 1, wherein the instrument is a Persian percussion instrument called "Tombak".

5. The tuning apparatus of claim 1, wherein the at least one cable-adjusting-component is a bolt or screw.

6. The tuning apparatus of claim 1, wherein the plate-adjusting-component is a bolt or screw.

7. The tuning apparatus of claim 1, wherein there are more than one cable attaching each cable-adjusting-component to the membrane circumference.

8. The tuning apparatus of claim 1, wherein there is at least one wall-mounted-cable-adjusting-component that is connected to a point of a cable which is between the cable-adjusting-component and the membrane circumference and that is adjustable through a hole in a wall of the resonance box, wherein adjusting the wall-mounted-cable-adjusting-component also changes the tension in the cable and tunes the membrane.

9. The tuning apparatus of claim 8, wherein the wall-mounted-cable-adjusting-component is a bolt or screw.

10. The tuning apparatus of claim 1, wherein multiple cables are attached to one cable-adjusting-component.

11. A tuning method for tuning a percussion instrument that has a resonance box and a drumhead membrane which covers at least one side of the resonance box, the tuning method comprising:

adjusting overall tension of the membrane by adjusting a first cable-adjusting-component and pulling all cables attached to the membrane's circumference at the same time;

adjusting local tensions of the membrane's regions by adjusting one or more second cable-adjusting-components and pulling each desired cable attached to the membrane's circumference individually, wherein the second cable-adjusting-components are adjustably mounted on the first cable-adjusting-component and wherein each of the second cable-adjusting-components are directly connected to a subset of the cables; and wherein the first cable-adjusting-component is moveably attached to a base-structure inside the resonance box, and wherein the base-structure does not move with respect to the resonance box during tuning.

12. The tuning method of claim 11, wherein the membrane is animal skin or synthetic skin.

13. The tuning method of claim 11, wherein the at least one cable-adjusting-component is a bolt or screw and wherein the adjustment-plate is adjusted by a bolt or screw.

14. The tuning method of claim 11, wherein there are more than one cable-adjusting-component and/or more than one cable attaching the cable-adjusting-components to the membrane circumference and wherein multiple cables are attached to one cable-adjusting-component.

15. The tuning method of claim 11, wherein there is at least one wall-mounted-cable-adjusting-component that is connected to a point of the cable which is between the cable-adjusting-component and the membrane circumference and that is adjustable through a hole in a wall of the resonance box, wherein adjusting the wall-mounted-cable-adjusting-component also changes the tension in the cable and tunes the membrane.

16. The tuning method of claim 15, wherein the wall-mounted-cable-adjusting-component is a bolt or screw.

17. A tunable percussion system comprising:

a resonance box;

a drumhead membrane which covers at least one side of the resonance box;

a base-structure situated inside the resonance box, in contact with or attached to inside of the resonance box, such that the base-structure does not move with respect to the resonance box during tuning;

an adjustment-plate moveably attached to the base-structure, wherein a distance between the base-structure and the adjustment-plate is adjustable by a plate-adjusting-component;

multiple cable-adjusting-components moveably mounted on the adjustment-plate;

multiple cables that connect the cable-adjusting-components to the membrane's circumference, wherein each cable-adjusting-component is directly connected to a subset of the multiple cables; and wherein moving at least one cable-adjusting-component relative to the adjustment-plate changes the tension in at least one cable that is attached to a point of the membrane's circumference and tunes the membrane locally and moving the adjustment-plate relative to the base-structure changes the tension in the multiple cables that are attached to the membrane's circumference and tunes the membrane globally, and wherein the tension in each cable can be adjusted without affecting the tension in other cables.

18. The system of claim 17, wherein there is at least one wall-mounted-cable-adjusting-component that is connected to a point of a cable which is between the cable-adjusting-component and the membrane circumference and that is adjustable through a hole in a wall of the resonance box, wherein adjusting the wall-mounted-cable-adjusting-component also changes the tension in the cable and tunes the membrane.

19. The system of claim 18, wherein the wall-mounted-cable-adjusting-component and/or the cable-adjusting-component and/or the plate-adjusting-component is a bolt or screw, the membrane is animal skin or synthetics, and the resonance box is wooden, metal, fiberglass, or any synthetic material.

20. The system of claim 17, wherein multiple cables are attached to one cable-adjusting-component.

* * * * *